US010017901B2

(12) United States Patent
Ketzer et al.

(10) Patent No.: US 10,017,901 B2
(45) Date of Patent: Jul. 10, 2018

(54) NON-WOVEN FABRIC MADE WITH BINDER SYSTEM

(71) Applicant: JOHNS MANVILLE, Denver, CO (US)

(72) Inventors: Michael Ketzer, Collenberg (DE); Klaus Friedrich Gleich, Nuremberg (DE)

(73) Assignee: Johns Manville, Denver, CO (US)

( * ) Notice: Subject to any disclaimer, the term of this patent is extended or adjusted under 35 U.S.C. 154(b) by 59 days.

(21) Appl. No.: 14/823,073

(22) Filed: Aug. 11, 2015

(65) Prior Publication Data

US 2016/0047089 A1 Feb. 18, 2016

(51) Int. Cl.

| | |
|---|---|
| ***D21H 13/40*** | (2006.01) |
| ***D04H 1/4209*** | (2012.01) |
| ***D04H 1/4218*** | (2012.01) |
| ***D04H 1/587*** | (2012.01) |
| ***D04H 1/64*** | (2012.01) |
| ***D04H 1/732*** | (2012.01) |

(52) U.S. Cl.

CPC ..... *D21H 13/40* (2013.01); *D04H 1/4209* (2013.01); *D04H 1/4218* (2013.01); *D04H 1/587* (2013.01); *D04H 1/64* (2013.01); *D04H 1/732* (2013.01)

(58) Field of Classification Search

CPC ..... D21H 13/40; D21H 17/67; D21H 17/63; D21H 17/64; D21H 17/65; D21H 17/66; D21H 17/675; D21H 13/38; D21H 21/18; D21H 13/16; D21H 13/36; D21H 17/35; D04H 1/4218; D04H 1/64; D04H 1/4209; D04H 1/587; D04H 1/60; D04H 1/732; Y10T 442/20; Y10T 442/60; Y10T 428/249946; Y10T 428/273; Y10T 442/623; Y10S 428/921

See application file for complete search history.

(56) References Cited

U.S. PATENT DOCUMENTS 5,484,653 A * 1/1996 Kennedy ..... B32B 5/02 428/921
5,965,257 A 10/1999 Ahluwalia
7,435,694 B2 * 10/2008 Kajander ..... B32B 5/26 428/292.1
7,521,385 B2 * 4/2009 Ahluwalia ..... A47C 31/001 428/920
8,563,449 B2 * 10/2013 Mueller ..... B32B 5/08 428/373
9,387,626 B2 * 7/2016 Zhang ..... C08K 7/14
9,650,783 B2 * 5/2017 Ullrich ..... E04B 1/941
2006/0292948 A1 * 12/2006 Geel ..... D21H 13/40 442/59
2008/0014814 A1 * 1/2008 Geel ..... D04H 1/4326 442/59
2008/0014815 A1 * 1/2008 Geel ..... C08J 5/10 442/59
2008/0050565 A1 * 2/2008 Gross ..... B32B 5/22 428/212
2009/0130416 A1 * 5/2009 Geel ..... D04H 1/4326 428/220
2009/0252941 A1 * 10/2009 Mueller ..... C04B 26/02 428/219
2009/0253323 A1 * 10/2009 Mueller ..... B32B 5/08 442/150
2010/0143684 A1 * 6/2010 Geel ..... D21H 13/38 428/220
2011/0263174 A1 * 10/2011 Ketzer ..... B32B 21/02 442/327
2012/0196081 A1 * 8/2012 Gleich ..... C09J 161/00 428/116
2013/0260627 A1 * 10/2013 Gleich ..... B32B 27/02 442/164
2013/0323497 A1 * 12/2013 Ullrich ..... B32B 5/26 428/316.6
2014/0256201 A1 * 9/2014 Zhang ..... C08K 7/14 442/181
2015/0308111 A1 * 10/2015 Kemp ..... B32B 5/26 181/290
2016/0046107 A1 * 2/2016 Zhang ..... B29B 15/105 442/60
2016/0047089 A1 * 2/2016 Ketzer ..... D21H 13/40 162/156
2016/0222849 A1 * 8/2016 Middendorf ..... D04H 1/4209
2016/0268640 A1 * 9/2016 Guo ..... D04H 1/4218

FOREIGN PATENT DOCUMENTS

DE 102007012651 A1 * 9/2008 ..... B32B 5/28
DE 102007028531 A1 * 12/2008 ..... B32B 5/02
EP 2 644 762 A1 10/2013

* cited by examiner

*Primary Examiner* — Jose A Fortuna
(74) *Attorney, Agent, or Firm* — Robert D. Touslee

(57) ABSTRACT

The present invention concerns a method for the production of high-filled, preferably wet-laid non-woven fabrics, in particular non-woven glass fiber fabrics, which have a very low binder content, as well as the non-woven glass fiber fabrics produced according to this method and the use thereof.

6 Claims, No Drawings

NON-WOVEN FABRIC MADE WITH BINDER SYSTEM

BACKGROUND OF THE INVENTION

The present invention concerns a method for the production of high-filled, preferably wet-laid non-woven fabrics, in particular non-woven glass fiber fabrics, which have a very low binder content, as well as the non-woven glass fiber fabrics produced according to this method and the use thereof.

The production of non-woven fabrics, particularly wet-laid non-woven fabric has been known for more than 50 years and uses the methods and devices initially developed for paper manufacturing.

DETAILED DESCRIPTION OF THE INVENTION

For the production of wet-laid, for example non-woven glass fiber fabrics, the glass fibers are dispersed in a so-called pulper in water, wherein the content of glass fibers is approx. 0.1-1% by weight. Here, one must ensure that the glass fibers are damaged as less as possible during the dispersion, i.e. essentially no fiber breaking occurs. The dispersed glass fibers are temporarily stored in one or more storage vessels. The discharge takes place through the material outlet, wherein the concentration of glass fibers is reduced by a factor 10 to 20. The discharge takes place to a circumferential Fourdrinier wire through which the water is sucked up and the wet-laid non-woven glass fiber fabric is formed. The sucked up water is supplied again to the process, i.e. recycled.

Following this, a binder is applied onto the non-woven glass fiber fabric, which has just been formed, which binder effects consolidation of the non-woven glass fiber fabric after drying or hardening so that it can be rolled up resp. post-treated.

Depending on the range of application, the glass fiber materials, glass fiber lengths and glass fiber diameters as well as the weights per unit area and the binder application are set up. In particular during the production of wet-laid non-woven glass fiber fabrics with a low binder content, problems arise, for example, through rupture.

Glass fiber non-woven fabrics are suitable among others for manufacturing planar rolled goods or sheet goods, in particular in conjunction with so-called B-stage capable binders, which have already been known for a few years now. They are used among others in the manufacture of decorative composite materials.

Furthermore, non-woven fabrics, in particular glass non-woven fabrics for impregnation with B-stage resins are also already known, wherein mineral fillers can be present in the B-stage binder resin. Such materials are suitable for manufacturing flame resistant laminates, such as described in EP2431173A1.

Furthermore, non-woven fabrics with mineral filler materials for gypsum board reinforcements or so-called non-woven wallpapers with mineral coatings, which require additional painting after installation on the wall, are also known.

For use of the above-mentioned materials for manufacturing decorative materials such as, for example, CPL or HPL, which are used in ships or in particular in public and/or commercially used buildings, they must be more and more secure with respect to the danger that one can be exposed to through fire. The increased fire protection requirements are known in the technical field due to constantly tightened legal regulations. These increased requirements also increasingly include individual components of interior finishings, such as laminates for furniture and building elements. Such decorative elements, taken alone, are partially to be classified as not safe with respect to the fire protection requirements, or can be realized in such a manner that they are fire-safe only with high expenditure. For example, high contents of flame retardants are admixed for paper-based laminates in order to render flammable paper hardly flammable or inflammable. Through the use of glass non-woven fabrics as carrier of such decorative materials, the fire protection requirements can mostly be met easier. However, a high binder content in the non-woven fabric often ruins the advantage of inorganic non-woven fabrics.

One of the most important properties of HPL (High Pressure Laminates) in the building industry is their fire behavior. The fire behavior is tested in Europe according to EN 13501, A1 and A2 classification as non-inflammable materials are additionally tested according to ISO 1716, wherein here, among others, the heating value of the material must be ≤3 MJ/kg.

Current flame-resistant HPL consist of (eventually also flame-retardant) papers, which are impregnated with flame-retardant synthetic resins and pressed under high pressure and at temperatures about 150° C. in multi-platen presses to intrinsically homogeneous monolithic panel bodies.

The classification of these materials takes place, as mentioned above, according to EN 13501, wherein the Class B1 (hardly inflammable), which can be obtained in the best case, is achieved. Due to the use of cellulose as carrier material and synthetic resins as binding agent in the HPL, fire class A according to ISO 1716 can not be achieved with traditional flame-resistant HPL according to the prior art.

Fiber cement panels like the one that are currently manufactured by a plurality of producers worldwide can be represented as A2 materials (according to ISO 1716), but they have a very low mechanical strength and are used, also due to their low surface quality, only in trivial decorative tasks.

Patent application WO 2006/111458 A1 describes a laminate panel as well as a method for manufacturing it, wherein it has a heating value ≤3 MJ/kg, as tested according to ISO 1716.

In particular glass non-woven fabrics have calorimeter values of less than 6000 J/kg compared to paper with >10,000 J/kg and thus have per se an appropriate fire resistance. Thereby, it is possible to produce flame-resistant laminates for façades, wall coverings, floor coverings or ceiling coverings or furniture in a very simple and secure manner.

Glass non-woven fabric, which are suitable for finishing with B-stage binder have, however, a high content of organic components in the reaction product. For multi-layer laminates, and for a comparable thickness, the higher number of glass non-woven fabrics also entails higher costs.

Thus, an object of the present invention was to provide non-woven fabrics, which are on the one hand suitable as carrier for decorative elements, which can be subsequently finished or coated with a B-stage binder, wherein only a minimal content of a B-stage binder is required so that the maximum calorimeter value is not exceeded. At the same time, there was the object of allowing cost-effective multi-layer structures in laminates through a reduced number of non-woven fabric layers. Furthermore, these materials must be suitable to be able to withstand high mechanical loads even in a humid environment in order to be suited for outdoor applications such as for façade elements. With the help of the non-woven fabric made of inorganic fibers according to the invention, fire class A2 can be achieved for the laminates with an energy value of ≤3 MJ/kg and at the same time, with the advantageous properties, in terms of application technology, of non-woven fabrics made of inorganic fibers, in particular glass non-woven fabrics, combined with B-stage binders. The high-filled non-woven fabric produced according to the invention can under certain conditions even achieve the fire class A1 with an energy value ≤2.0 MJ/kg.

Therefore, an object of the present invention is a continuous method for the production of non-woven fabrics, comprising the measures of:

(i) dispersing fibers in a liquid or gaseous medium,
(ii) applying the fibers dispersed in the medium onto the top side of a circumferential Fourdrinier wire,
(iii) formation of a non-woven fabric by sucking off the medium in which the fibers were dispersed from the underside of the circumferential Fourdrinier wire,
(iv) applying, where appropriate, a pre-binder and, if necessary, removing excess pre-binder as well as drying the non-woven fabric impinged with pre-binder,
(v) applying a binder and, if necessary, removing excess binder, wherein the binder can have another composition than the pre-binder optionally used previously in measure (iv), and drying the non-woven fabric impinged with binder,
(vi) rolling up the fabric web received, characterized in that (vii) the binder in measure (v) is a binder system (binder system I), which has at least one organic binder and at least one inorganic filler, and
(ix) the applied quantity of the binder system I in measure (v) is between 30 and 90% by weight, preferably between 35 and 75% by weight, wherein the value refers to the total weight of the non-woven fabric after complete drying, and
(x) the content of organic binder(s) in the binder system I according to (vii) is between 2 and 20% by weight, preferably between 5 and 16% by weight, wherein the value refers to the binder system I after complete drying,
(xi) the content of inorganic filler(s) in the binder system I according to (vii) is between 98 and 80% by weight, preferably between 95 and 84% by weight, wherein the value refers to the binder system I after complete drying.

The sum of the contents of organic binder(s) and of inorganic filler(s) in the binder system I is usually 100%; the usually used additives like anti-foaming agents, dispersing agents, water retention agents (e.g. cellulose) etc. are not contained herein and can be present in quantities between 0 and 5% by weight, wherein the value refers to the pre-binder or binder system I after complete drying.

The preferably wet-laid, high-filled non-woven fabrics produced by means of the method according to the invention have a good mechanical strength along with a low binder content and in particular suitable for the production of B-stage capable non-woven fabrics, which can in turn be used for the production of composite materials, in particular composite materials with a low fire load. Here, the subsequent impregnation or coating of the non-woven fabric according to the invention can be performed advantageously using standard impregnation processes.

The high-filled, preferably wet-laid non-woven fabrics produced by means of the method according to the invention are thus precious intermediate products in the production of B-stage capable non-woven fabrics.

Another subject matter of the present invention is thus a wet-laid or dry-laid non-woven fabric made of inorganic fibers, in particular made of glass fibers, which is consolidated with a binder system (binder system I), which has at least one organic binder and at least one inorganic filler, wherein:

(i) the applied quantity of the binder system I is between 30 and 90% by weight, preferably between 35 and 75% by weight, wherein the value refers to the total weight of the non-woven fabric after complete drying, and
(ii) the content of organic binder(s) in the binder system I is between 2 and 20% by weight, preferably between 5 and 16% by weight, wherein the value refers to the binder system I after complete drying,
(iii) the content of inorganic filler(s) in the binder system I is between 98 and 80% by weight, preferably between 95 and 84% by weight, wherein the value refers to the binder system I after complete drying, and
(iv) the non-woven fabric consolidated with the binder system I (after drying of the binder system I) has a Gurley porosity (base 100 ml) of at most 200 sec, preferably of less than 100 sec.

The method according to the invention is likewise suitable for the production of wet-laid or dry-laid non-woven fabrics. Insofar they are wet-laid non-woven fabrics, water is usually used as the liquid medium; for dry-laid non-woven fabrics, air is usually used as the gaseous medium. The method according to the invention is preferably used for the production of wet-laid non-woven fabrics.

Fibers

The fibers used in measure (i) are discontinuous fibers, i.e. so-called staple fibers or chopped fibers. The fiber-forming materials are preferably inorganic fibers, in particular ceramic fibers, mineral fibers or glass fibers, wherein they can also be used in the form of mixtures.

The mineral and ceramic fibers are aluminosilicate fibers, ceramic fibers, dolomite fibers, wollastonite fibers or fibers of vulcanites, preferably basalt fibers, diabase fibers and/or melaphyre fibers, especially basalt fibers. Diabases and melaphyres are designated collectively as paleobasalts and diabase is also often designated as greenstone.

Suitable glass fibers comprise those manufactured from A-glass, E-glass, S-glass, T-glass or R-glass.

The average length of the mineral fibers or glass fibers is between 5 and 120 mm, preferably 6 to 30 mm, particularly preferably between 10 and 26 mm. The average fiber diameter of the mineral fibers or glass fibers is between 5 and 30 μm, preferably between 6 and 22 μm, especially preferably between 10 and 18 μm.

In addition to the above-mentioned diameters, so-called glass microfibers can also be used. The preferred average diameter of the glass microfibers is between 0.1 and 5 μm.

Fiber Dispersion

In addition to non-woven fabrics produced according to dry methods, the non-woven fabrics are preferably produced by means of wet laid methods. The measures required for the wet-laid methods for dispersion of the fibers used in step (i) are known to those skilled in the art. The exact process conditions depend on the fiber materials and the desired weight per unit area of the non-woven fabric to be formed.

The processes described hereinafter refer by way of example to the production of non-woven glass fiber fabrics; however, the corresponding process steps are similar also for other fiber materials, in particular for inorganic fibers, and are known to those skilled in the art.

Fundamentally, the fibers are dispersed in a so-called pulper in water, wherein in the case of glass fibers the content of the glass fibers is approx. 0.1% by weight to 1% by weight.

The dispersed glass fibers are usually temporarily stored in one or more storage vessels, wherein the deposition of the glass fibers must be prevented. This measure is also known to those skilled in the art.

The discharge of the glass fiber/water dispersion or the application according to measure (ii) takes place through the material outlet, wherein the concentration of glass fiber is reduced by a factor 10-20. This measure is also known to those skilled in the art.

Further auxiliary materials can be added to the water used for production of the glass fiber/water dispersion. Here, it is usually thickening agents and surfactants. This measure is also known to those skilled in the art.

The discharge of the fiber/water dispersion takes place to a circumferential Fourdrinier wire through which the water is sucked up and the wet-laid fiber fabric is formed (measure (iii)). The sucked up water is supplied again to the process, i.e. recycled. For the production of the wet-laid glass non-woven fabrics, known devices are used, such as Voith Hydroformer® or Sandy Hill Deltaformer®, which are known in the market.

The weight per unit area of the non-woven fabric made of inorganic fibers formed, in particular the non-woven glass fiber fabric formed, is preferably between 10 and 350 g/m$^2$, in particular between 50 and 300 g/m$^2$, wherein these values refer to a glass non-woven fabric without any binders and fillers (but, however, if necessary with a pre-binder) and without taking into account the residual humidity, i.e. after drying.

Binder

In measure (iv), a binder system (binder system I), which has at least one organic binder and at least one inorganic filler is applied onto the freshly formed, preferably wet-laid non-woven fabric made of inorganic fibers, preferably onto freshly formed wet-laid glass non-woven fabric, which has just been formed and still is on the circumferential Fourdrinier wire.

The content of organic binder(s) in the binder system I is between 2 and 20% by weight, preferably between 5 and 16% by weight, wherein the value refers to the binder system after complete drying, and the content of inorganic filler(s) in the binder system I is between 98 and 80% by weight, preferably between 95 and 84% by weight, wherein the value refers to the binder system after complete drying.

The entire applied quantity of the binder system I (binders and fillers) in measure (v) is between 30 and 90% by weight, preferably between 35 and 75% by weight, wherein the value refers to the total weight of the non-woven fabric after complete drying. Excess binder can be sucked up via the Fourdrinier wire, so that the binder system is available uniformly distributed.

The organic binder(s) in the binder system I are fundamentally subject to no limitations, so that all organic binders known in the production of non-woven fabrics can be used. The binders are chemical binders, preferably based on urea, phenol formaldehyde, melamine formaldehyde or mixtures therefrom, formaldehyde-free binders, self-cross-linking binders, which completely react through chemically without any addition of a catalyst. The cross-linking is preferably induced thermally. It has proved that in particular aqueous polymer dispersions, polymer dispersions of vinyl acetate and ethylene, or similar self-cross-linking, in particular thermally self-cross-linking binders are suitable self-cross-linking binders. Urea binders are particularly suitable. The above-mentioned chemical binders can additionally have saccharin and/or starch.

In addition to the above-mentioned organic binders, inorganic binders can also be used. Such inorganic binders can almost fully or at least partially replace the above-mentioned organic binders, i.e. be used in mixtures with the above-mentioned organic binders. A suitable inorganic binder is for example water glass, in particular based on sodium silicate. The content of inorganic binders is between 0 and 18% by weight, wherein the value refers to the binder system I after complete drying, The inorganic fillers in the binder system I are likewise fundamentally subject to no limitations, so that all inorganic fillers known in the production of non-woven fabrics can be used. The inorganic fillers are mineral fillers, preferably loam, clay, calcined loam, calcined clay, lime, chalk, natural and/or synthetic carbonates, natural and/or synthetic oxides, carbides, natural and/or synthetic hydroxides, sulfates and phosphates, based on natural and/or synthetic silicates, silicic acids, silicon and/or quartz, fluorspar or talc. Optionally, the fillers are silanized or additionally hydrophobized.

In a variant of the method according to the invention, the application of the binder system can also take place in two steps, whereby a better distribution of the binder and of the inorganic filler can be achieved. For this embodiment, a pre-binder is at first applied, which pre-binder has at least one organic binder and at least one inorganic filler (pre-binder system), wherein the content of organic binder(s) is between 2 and 20% by weight, preferably between 5 and 16% by weight, wherein the value refers to the pre-binder system after complete drying, and the content of inorganic filler(s) is between 98 and 80% by weight, preferably between 95 and 84% by weight, wherein the value refers to the pre-binder system after complete drying. Preferably, this pre-binder is different from the binder system I. After application of the pre-binder and prior to application of the binder system I, an intermediate drying can take place. Subsequently, the binder system I is applied according to the preceding description. The application of the binder system I can in this case also in take place in a separate process step, i.e. non-woven fabric impinged with the pre-binder can at first be temporarily stored as intermediate product and, to a later point in time, coated with the binder system I.

The content of inorganic binders in the pre-binder system is between 0 and 18% by weight, wherein the value refers to the pre-binder system after complete drying, The application of the filler-binder mixture, i.e. of the binder system I as well as, if applicable, of the pre-binder is carried out by means of known methods. For this purpose, in particular doctor blade, application roller, slit nozzle or curtain coating methods are suitable.

The filler-binder-mixture or the mixtures can in addition contain known additives like anti-foaming agents, dispersing agents, water retention agents (e.g. cellulose) etc. The content of these additives in binder I or in the pre-binder system is between 0 and 5% by weight, wherein the value refers to the pre-binder system or binder system I after complete drying, The drying in measure (v) takes place at temperatures between 90° C. and 250° C. max., wherein the dwell time in the dryer is typically between 30 and 60 seconds for the above-mentioned temperature range. The drying according to measure (v) effects that the binders harden or cross-link.

Drying devices, which are already prior art in the fiber technology are used for drying.

The high-filled non-woven fabric produced by means of the method according to the invention has a Gurley porosity (base 100 ml) of at most 200 sec, preferably of less than 100 sec.

Further additives for enhancement of the hydrophobic properties can be added to the produced non-woven fabric, such as silicon dispersions or silicon-impregnated minerals like calcium carbonates, which can improve the stability compared to water. Further known additives like thickeners, anti-foaming agents etc. can likewise be admixed. Furthermore, further additives can also be added for enhancement of the fire properties; for instance, aluminum hydroxides or barium hydroxides or phosphorus compounds are suitable.

The high-filled non-woven fabric is confectioned after the drying as roller goods, plate goods or sheet goods and is available for further treatment at the customers place.

The high-filled non-woven fabric produced by means of the method according to the invention is subsequently impinged or impregnated with a low content of a B-stage binder and post-processed to yield the reaction product. In this context, merely 3-30% by weight, preferably 5-17% by weight of such a B-stage binder, with reference to the high-filled non-woven fabric used, which was produced by means of the method according to the invention, is required.

Optionally, the B-stage binder can also contain inorganic fillers. Here, the filler content can be up to 4 times the B-stage binder content, wherein the value refers to the respective contents after complete drying. The inorganic fillers in the B-stage binder are likewise fundamentally subject to no limitations, so that all inorganic fillers known in the production of non-woven fabrics can be used. The inorganic fillers are mineral fillers, preferably loam, clay, calcined loam, calcined clay, lime, chalk, natural and/or synthetic carbonates, natural and/or synthetic oxides, carbides, natural and/or synthetic hydroxides, sulfates and phosphates, based on natural and/or synthetic silicates, silicic acids, silicon and/or quartz, fluorspar or talc. Optionally, the fillers are silanized or additionally hydrophobized.

B-stage capable binders are understood to mean binders that are only partially consolidated or hardened, i.e. are available in the B-stage state, and can still experience a final consolidation, e.g., by thermal post-treatment. Such B-stage binders are described in detail in U.S. Pat. No. 5,837,620, U.S. Pat. No. 6,303,207 and U.S. Pat. No. 6,331,339. The B-stage binders disclosed therein are also an object of the present invention. B-stage binders are preferably binders based on furfuryl alcohol formaldehyde resins, phenol formaldehyde resins, melamine formaldehyde resins, urea formaldehyde resins and mixtures thereof. Preferably, these are aqueous systems. Further preferred binder systems are formaldehyde-free binders. B-stage binders are characterized in that they can be subjected to a multistage hardening, that is, they still have a sufficient binding action after the first hardening or after the first hardenings (B-stage state) so that they can be used for the further processing. Such binders are usually hardened in one step after the addition of a catalyst at temperatures of ca. 350° F. The B-stage binders should have as far as possible a calorimeter value ≤3 MJ/kg.

In order to form the B-stage, such binders are optionally hardened after the addition of a catalyst. The amount of hardening catalyst is up to 10% by weight, preferably 0.1 to 5% by weight (based on the total binder content). For example, ammonium nitrate as well as organic aromatic acids, e.g., maleic acid and p-toluenesulfonic acid, are suitable as hardening catalyst since it allows the B-stage state to be reached quicker. In addition to ammonium nitrate, maleic acid and p-toluenesulfonic acid, all materials are suitable as hardening catalyst that have a comparable acidic function. In order to reach the B-stage, the textile fabric impregnated with the binder is dried under the influence of temperature without producing a complete hardening. After drying, a residual humidity of 4 to 6% typically remains in the B-stage binder, which residual humidity almost disappears only after complete hardening reaction. The necessary process parameters are dependent on the binder system selected.

The lower temperature limit can be influenced by the selection of the duration or by adding more or stronger acidic hardening catalysts.

B-stage binders based on phenol formaldehyde (PF), urea formaldehyde (UF), melamine formaldehyde (MF), epoxide, or mixtures of UF binders and MF binders are particularly preferred.

The application of the B-stage capable binder system can take place by means of known methods. In addition to spraying, impregnating and pressing-in, the binder can also be applied by coating, for instance by means of doctor blade coating methods, application roller, slit nozzle or curtain coating methods, or by means of rotary nozzle heads. Furthermore, foam application is also fundamentally possible.

The above-mentioned preferred ranges for fiber length, fiber diameter, weight per unit area, binder and porosity can be combined freely, independently of each other, and any possible combination of the respectively preferred ranges is thus explicitly part of the present description.

Through the use of the high-filled non-woven fabrics manufactured by means of the method according to the invention, it is possible to achieve the appropriate fire classes without additional efforts with respect to reduction of the fire load. A cost-effective alternative also to existing glass non-woven fabric systems can be provided in particular for multi-layer systems. In addition, known manufacturing methods can be used at the customers place.

Reinforcement

The non-woven fabric based on inorganic fibers, in particular wet-laid glass non-woven fabrics produced by means of the method according to the invention can additionally have further reinforcement.

The supply of planar reinforcement typically takes place on the top side of the circumferential Fourdrinier wire on which the wet-laid non-woven glass fiber fabric is formed.

The supply of reinforcement fibers and/or yarns takes place as in the case of planar reinforcement or individually, i.e. from above or the side, wherein the reinforcement fibers and/or yarns are incorporated centrally in the non-woven fabric formed or on the top side and/or underside. The assembly position results from the exact positioning of in the area of non-woven formation on the Fourdrinier wire. Finally, restrictions merely apply due to the type of construction of the non-woven makers used.

Reinforcements include preferably reinforcing filaments and/or yarns whose Young module is at least 5 GPa, preferably at least 10 GPa, particularly preferred at least 20 GPa.

The reinforcing filaments, i.e. the monofilaments, rovings as well as the yarns have a diameter between 0.1 and 1 mm or 10-2400 tex, preferably 0.1 and 0.5 mm, particularly 0.1 and 0.3 mm and have an elongation at break of 0.5 to 100%, preferably 1 to 60%.

Filaments, in particular multifilaments and/or monofilaments on the basis of carbon, glass, glass fiber rovings, mineral fibers (basalt) or wires (monofilaments) composed of metals or metal alloys, are preferably used as reinforcements.

For economic reasons, preferred reinforcements consist of glass multifilaments in the form of—essentially—parallel yarn sheets or scrims. In most cases, the glass non-woven fabrics are reinforced in the longitudinal direction by—essentially—parallel yarn sheets.

The reinforcing filaments can be used arranged as nets, lattices or scrims. Furthermore, reinforcements in the form of woven fabrics and multiaxial scrims are also preferred. Reinforcements with reinforcing yarns running parallel to each other, i.e. warp sheets, as well as scrims or lattice fabrics are particularly preferred.

Depending on the wanted property profile, the density of the filaments may vary in wide limits. Preferably the filament density is between 20 and 250 filaments per meter. The filament density is measured vertically to the running direction. The reinforcing filaments are preferably supplied prior to the formation of the glass non-woven fabric on the top side of the circumferential Fourdrinier wire. It is, however, possible to supply the filaments during the formation of the glass non-woven fabric, so that they are incorporated.

Applications

The non-woven fabrics according to the invention can be used for the production of composite materials and laminates, in particular for use of "High Pressure Laminates" (HPL) or "Continuous Pressure Laminates" (CPL). Through the use of these non-woven fabrics, it is possible to achieve at least the fire class A2 or similar or comparable fire protection standards for such materials. The high-filled non-woven fabrics according to the invention allow the manufacture of cost-effective multi-layer structures through a low number of non-woven fabric layers.

Due to the particular fire protection properties, the non-woven fabrics according to the invention are suitable for the production of decorative materials, e.g. for ships and trains, in public and/or commercially used buildings, as integral parts of interior finishings or as laminates for furniture elements.

General Measurement Methods:

To such extent not already specified, the following methods are applied:

Gurley porosity: The Gurley porosity determined in accordance with ISO 5636-1 (1984). For uneven surfaces a rubber O-ring seal is used for sealing.

Weight per unit: The weight per unit area is determined in accordance with DIN EN ISO 29073-1 (1992).

Fiber diameter: The fiber diameter is determined in accordance with DIN EN ISO 1973 (As of: 1995).

Young Module: The Young Module is determined via the stress-strain curve (elastic range) at room temperature (23° C.)

according to ASTM E111-04 (2010) DOI: 10.1520/E0111-04R10; publication date (2010).

EN 13501: The test has the following citation:

DIN EN 13501-1: 2010-01. German Edition EN 13501-1:2007+A1:2009: "CLASSIFICATION OF REACTION TO FIRE PERFORMANCE IN ACCORDANCE"

ISO 1716: The test has the following citation:

DIN EN ISO 1716:2010-11. German Edition EN ISO 1716:2010: Reaction to fire tests for products—Determination of the gross heat of combustion (included in EN 13501-1:2007)

EXAMPLES

Example 1

A glass non-woven fabric was produced according to the wet laid method (standard method). For this purpose, cut glass fibers (16μ, 24 mm) were dispersed in water and deposited by means of appropriate devices onto a deposition screen belt. After suction of the excess water, the binder application is carried out by means of a foulard.

The weight per unit area of the glass fiber non-woven fabric was 150 g/m$^2$ (after drying). The subsequent binder application was performed to the extent of 100 g/m$^2$, wherein the organic binder content was 8% (20 g/m$^2$) of the total area weight (after drying) and the filler content 32% (80 g/m$^2$). Urecoll® 150 of the company BASF was used as the organic binder; the filler was made of ATH (aluminum tri-hydrate). Complete drying of the non-woven fabric followed. The measured calorimeter value of the high-filled non-woven fabric was equal to approx. 0.5 kJ/g and thus fulfilled the requirements for the fire class A1.

The impregnation of the high-filled non-woven fabric with a B-stage binder was then performed. A melamine binder was used as B-stage binder, wherein 10% of the binder (with reference to the total weight) was applied. Drying was carried out up to a residual humidity of 4-6%, wherein this value refers to the total weight of the non-woven fabric.

The total weight of the high-filled non-woven fabric including the B-stage binder was equal to 275 g/m$^2$ (including 4% residual humidity). The calorimeter value was equal to 2,900 kJ/kg and thus achieves fire class A2.

Example 2

A non-woven fabric according to Example 1 was produced, wherein the weight per unit area of the non-woven fabric without binder was 250 g/m$^2$. The subsequent binder application was performed to the extent of 200 g/m$^2$, wherein the organic binder content was 8% (36 g/m$^2$) of the total area weight (after drying) and the filler content 32% (144 g/m$^2$). Urecoll® 150 of the company BASF was used as the organic binder; the filler was made of ATH (aluminum tri-hydrate).

The impregnation of the high-filled non-woven fabric with a B-stage melamine binder, which contained fillers was then performed. The coating compound was made of 77% (150 g/m$^2$) of fillers and 23% (45 g/m$^2$) of B-stage binder with reference to a 195 g/m$^2$ coating. The total weight of the non-woven fabric was equal to 645 g/m$^2$ (including 4% residual humidity). The calorimeter value was equal to 2,650 kJ/kg and thus achieves fire class A2.

What is claimed is:

1. A wet-laid or dry-laid non-woven fabric made of inorganic fibers, which is treated with a binder system, binder system I, which has at least one organic binder and at least one inorganic filler, and wherein:

(i) the applied quantity of the binder system I is between 30 and 90% by weight, wherein the value refers to the total weight of the non-woven fabric after complete drying, and (ii) the content of organic binder(s) in the binder system I is between 2 and 20% by weight, wherein the value refers to the binder system I after complete drying, (iii) the content of inorganic filler(s) in the binder system I is between 98 and 80% by weight, wherein the value refers to the binder system I after complete drying, (iv) the non-woven fabric consolidated with the binder system I, after drying the binder system I, has a Gurley porosity, base 100 ml, of at most 200 sec; and (v) the non-woven fabric is impregnated with the binder such that the binder system is uniformly distributed within the non-woven fabric.

2. The non-woven fabric according to claim 1, characterized in that it has the fire class A2.

3. The non-woven fabric according to claim 1, wherein the applied quantity of the binder system I is between 35 and 75% by weight, wherein the value refers to the total weight of the non-woven fabric after complete drying.

4. The non-woven fabric according to claim 1, wherein the content of organic binder(s) in the binder system I is between 5 and 16% by weight, wherein the value refers to the binder system I after complete drying.

5. The non-woven fabric according to claim 1, wherein the content of inorganic filler(s) in the binder system I is between 95 and 84% by weight, wherein the value refers to the binder system I after complete drying.

6. The non-woven fabric according to claim 1, wherein the non-woven fabric consolidated with the binder system I, after drying of the binder system I, has a Gurley porosity, base 100 ml, of less than 100 sec.

* * * * *